US007690646B2

(12) United States Patent
Shida et al.

(10) Patent No.: US 7,690,646 B2
(45) Date of Patent: Apr. 6, 2010

(54) SHEET STORING DEVICE, POST-PROCESSING APPARATUS EQUIPPED WITH THE DEVICE AND IMAGE FORMING SYSTEM EQUIPPED WITH THE APPARATUS

(75) Inventors: Toshio Shida, Higashiyamato (JP); Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 150 days.

(21) Appl. No.: 11/900,074

(22) Filed: Sep. 10, 2007

(65) Prior Publication Data

US 2008/0106029 A1 May 8, 2008

(30) Foreign Application Priority Data

Nov. 2, 2006 (JP) ..... 2006-298684

(51) Int. Cl.
*B65H 29/38* (2006.01)

(52) U.S. Cl. ..... 271/181; 271/184; 271/216

(58) Field of Classification Search ..... 271/3.12, 271/181, 207, 216, 184; 270/32
See application file for complete search history.

(56) References Cited

U.S. PATENT DOCUMENTS

| | | | | |
|---|---|---|---|---|
| 3,814,415 | A * | 6/1974 | Hunter et al. | 271/181 |
| 4,019,730 | A * | 4/1977 | Staudinger et al. | 271/181 |
| 4,958,820 | A | 9/1990 | Johdai et al. | |
| 5,104,109 | A * | 4/1992 | Kubo | 271/3.12 |
| 6,076,825 | A * | 6/2000 | Kato et al. | 271/207 |
| 6,161,830 | A * | 12/2000 | Yap | 271/181 |
| 6,776,407 | B2 * | 8/2004 | Lindenmayer et al. | 271/176 |
| 6,877,739 | B2 * | 4/2005 | Leitz et al. | 271/178 |
| 6,889,973 | B2 * | 5/2005 | Gammerler et al. | 271/198 |
| 2002/0140160 | A1 * | 10/2002 | Gammerler et al. | 271/207 |
| 2003/0234485 | A1 * | 12/2003 | Gosslinghoff | 271/209 |
| 2004/0262832 | A1 | 12/2004 | Kaneko | |
| 2005/0189704 | A1 * | 9/2005 | Oexle et al. | 271/207 |
| 2008/0106024 | A1 | 5/2008 | Kayahara et al. | |

FOREIGN PATENT DOCUMENTS

| | | | |
|---|---|---|---|
| JP | 54-118067 | A | 9/1979 |
| JP | 03120127 | A * | 5/1991 |
| JP | 04028663 | A * | 1/1992 |
| JP | 04028664 | A * | 1/1992 |
| JP | 07-033309 | A | 2/1995 |
| JP | 07-112860 | A | 5/1995 |
| JP | 11-35211 | A | 2/1999 |

OTHER PUBLICATIONS

U.S. Appl. No. 11/900,250, entitled: "Sheet Storing Device Storing Sheets Upright, Post-Processing Apparatus Equipped With the Device and Image Forming System Equipped With the Apparatus," Inventor: Kayahara et al, filed Sep. 11, 2007.

* cited by examiner

*Primary Examiner*—Kaitlin S Joerger
(74) *Attorney, Agent, or Firm*—Frishauf, Holtz, Goodman & Chick, P.C.

(57) ABSTRACT

A sheet storing device having a conveyance device that converts the conveyance direction while holding the sheet and a storing section that has the first support member supporting the surface of the sheet substantially vertically, the second support member supporting the edge of the sheet and a pressing member pressing the sheet against the first support member, a post-processing apparatus equipped with the sheet storing device and an image forming system equipped with the aforesaid items.

13 Claims, 5 Drawing Sheets

SHEET STORING DEVICE, POST-PROCESSING APPARATUS EQUIPPED WITH THE DEVICE AND IMAGE FORMING SYSTEM EQUIPPED WITH THE APPARATUS

This application is based on Japanese Patent Application No. 2006-298684 filed on Nov. 2, 2006 in Japanese Patent Office, the entire content of which is hereby incorporated by reference.

BACKGROUND OF THE INVENTION

The present invention relates to a sheet storing device that stores a large number of sheets, a post-processing apparatus equipped with the sheet storing device and an image forming system equipped therewith, and in particular, to a sheet storing device that stores folded sheets.

A folded sheet takes a condition that plural sheets are superposed by folding operations to bulk up by swelling and to tend to take an irregular shape.

Conventionally, in the post-processing apparatus connected to an image forming apparatus, sheets folded and ejected have been stored in a box-shaped storing device under the irregular condition.

Therefore, there have been problems including that a capacity of the storing device runs short, that the ejected sheets scatter and that the management of the stored sheets is troublesome.

In Patent Document 1, there is disclosed a sheet storing device that aligns folded sheets to store them.

In the sheet storing device disclosed by Patent Document 1, sheets fed into the sheet storing device continuously are stopped temporarily by a stopping roller to avoid a lift of the sheet, and then the sheet is conveyed to a sheet storing section.

Patent Document 1 discloses two types of sheet storing devices, and in the first one of them, a succeeding sheet is inserted to be under a preceding sheet, whereby, a sheet is inserted into the bottom of sheets in the sheet storing section, thus, the sheets are stacked vertically in the lying situation in the sheet storing section. In the second one of them, a succeeding sheet is supplied onto the upper side of a preceding sheet, and sheets are stacked to be inclined at the storing section.

It is desired that the sheet storing device that stores folded sheets is capable of storing sheets aligned well. The Patent Document 1 satisfies this condition to some extent but does not have enough yet.

According to the aforementioned first type of the Patent document 1, sheets are piled up to be stored and an irregular storing condition occurs easily without any means to maintain the stacking condition. Further they may collapse when the storing amount increases.

As the storing amount increases, the pressure on the bottom portion of the stored sheets is enhanced to make it difficult to insert a sheet into the bottom portion, which brings a limit of storing amount.

According to the aforementioned second type of the Patent document 1, the storing condition tends to be irregular easily and there is a problem that the management of the stored sheets is not easy.

[Patent Document 1] Unexamined Japanese Patent Application Publication No. 11-35211

SUMMARY

Aspect of the present inventions are follows.

1. A sheet storing device having a conveyance device which conveys a sheet and a storing section for storing the sheet conveyed by the conveyance device, wherein the conveyance device changes the conveyance direction while holding the sheet, and the storing section has a first support member for supporting a surface of the sheet, a second support member for supporting an edge of the sheet, and a pressing member for pressing the sheet against the first support member, wherein the conveyance device holds and conveys the sheet, and then releases holding of the sheet so that the sheet is stored in the storing section.

2. A post-processing unit having a post-processing apparatus for folding a sheet and the above sheet storing device for conveying and storing the sheet folded by the post-processing apparatus.

3. An image forming system having an image forming apparatus for forming an image on a sheet, a post-processing apparatus for folding the sheet ejected from the image forming apparatus and the above sheet storing device for storing the sheet folded by the post-processing apparatus.

DETAILED DESCRIPTION OF THE PREFERRED EMBODIMENT

The invention will be described as follows, referring to the following embodiment, to which, however, the invention is not limited.

<Image Forming System>

Figure 1:
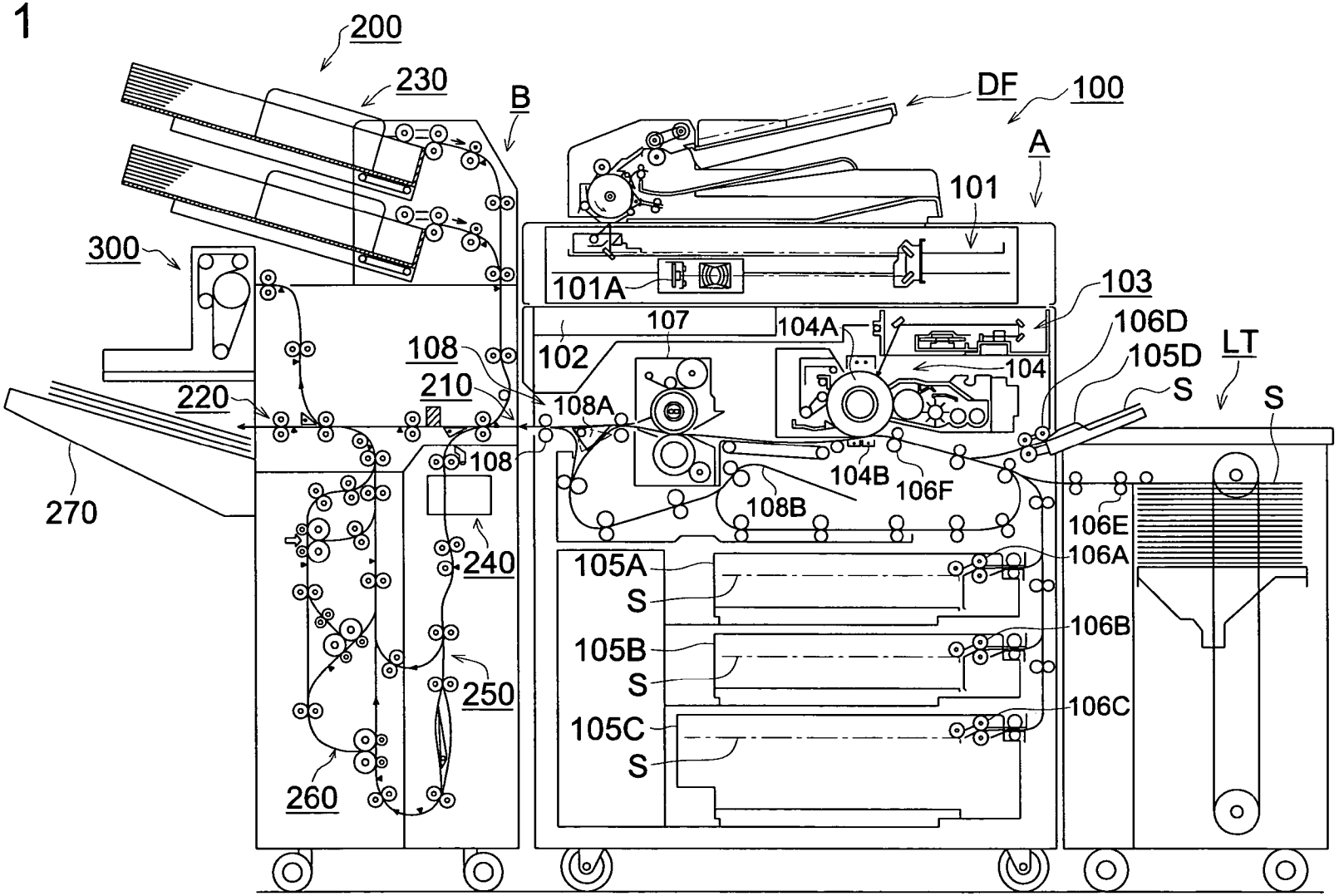
FIG. 1 is an overall structural diagram of an image forming system relating to an embodiment of the invention.

FIG. 1 is an overall structural diagram of an image forming system equipped with image forming apparatus 100, post-processing apparatus 200 having a folding device and sheet storing device 300.

Illustrated image forming apparatus 100 is equipped with automatic document feeder DF, image reading section (image input device) 101, image processing section 102, image writing section 103, image forming section 104, sheet feeding cassettes 105A, 105B and 105C, manual sheet feeding tray 105D, first sheet feeding sections 106A, 106B, 106C and 106D, second sheet feeding section 106F, fixing unit 107, sheet ejection section 108, automatic double-sided copy sheet feeding unit (ADU) 108B and with large capacity sheet feeding unit LT.

A document placed on a document table of automatic document feeder DF is conveyed, images on a single side or both sides of the document are read by an optical system of image reading section 101, and are read in by image sensor 101A.

Analog signals subjected to photoelectric conversion by image sensor 101A are subjected to analog processing, A/D conversion, shading correction and image compression processing in image processing section 102, and signals are sent to image writing section 103.

In the image writing section 103, light outputted from a semiconductor laser is projected on photoconductor drum 104A of image forming section 104 to form a latent image. In the image forming section 104, processes such as charging, exposure, developing, transfer, separation and cleaning are conducted. Images are transferred by transfer device 104B onto sheet S supplied by respective first sheet feeding sections 106A-106E from sheet feeding cassettes 105A-105C, manual sheet feeding tray 105D and large capacity sheet feeding unit LT. The sheet S carrying images is subjected to fixing processing by fixing unit 107 to be fed into post-processing apparatus 200 from sheet ejection section 108. Or, sheet S which has been finished on its one side in terms of image processing and has been fed into automatic double-sided copy sheet feeding unit 108B from conveyance path switching plate 108A is ejected from sheet ejection section 108 after being subjected to image processing on both sides in image forming section 104 again.

<Post-Processing Apparatus>

Post-processing apparatus 200 is composed of post-processing apparatus carry-in section 210, post-processing apparatus ejection section 220, sheet adding section (feeding section of sheet for cover) 230, hole-punching processing section (punching processing section, first processing section) 240, conveyance section 250, folding processor 260 and elevating sheet ejection section 270.

Figure 2:
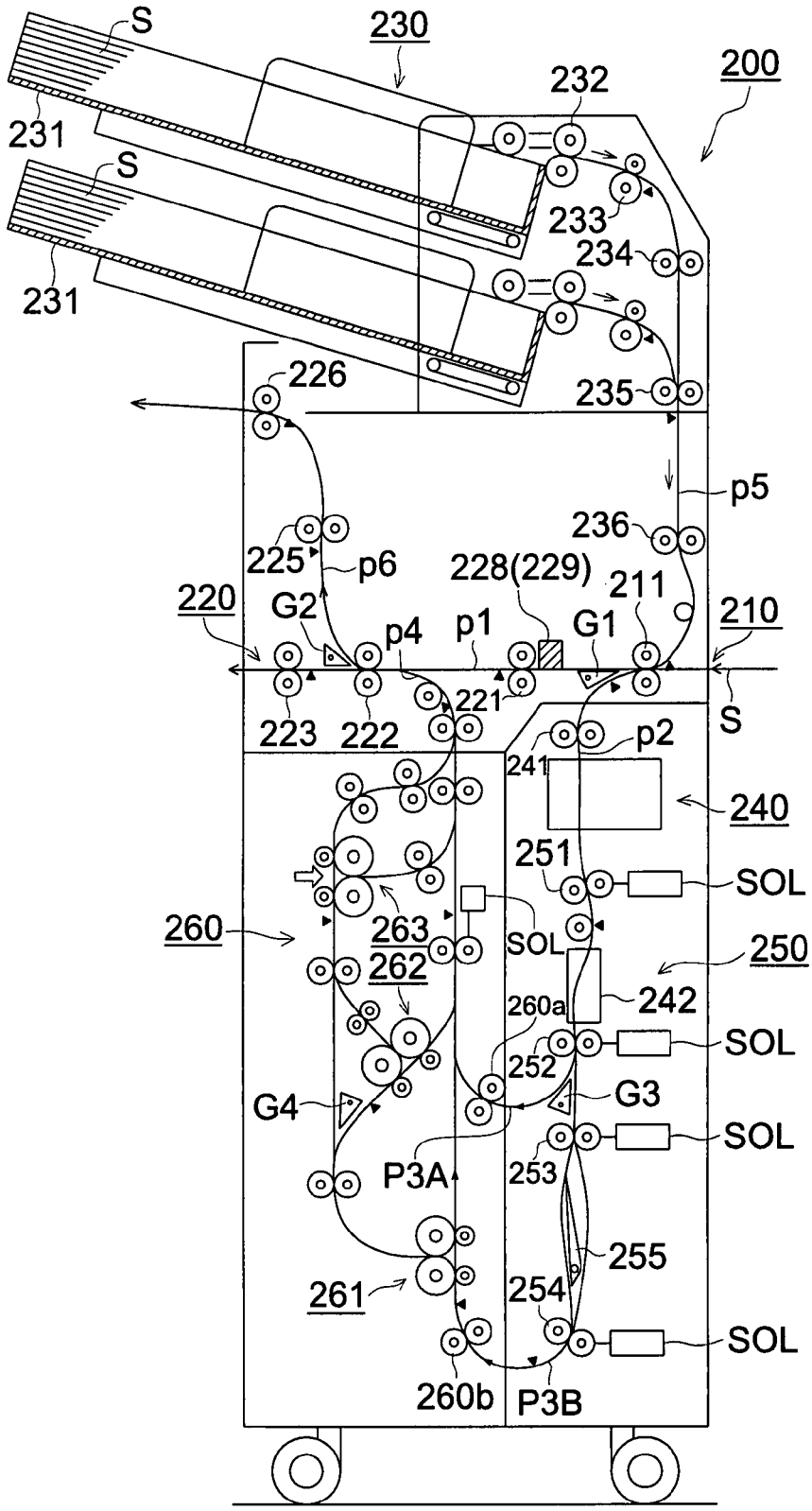
FIG. 2 is an overall structural diagram of a post-processing apparatus.

FIG. 2 is an overall structural diagram of post-processing apparatus 200.

Sheet S which has been subjected to image forming is introduced into the post-processing apparatus carry-in section 210 from image forming apparatus 100.

A sheet introduction position of the post-processing apparatus carry-in section 210 faces a sheet ejection position of sheet ejection section 108 of image forming apparatus 100.

Sheet S introduced to entrance roller 211 is branched by conveyance path switching device Gl to either one of post-processing apparatus ejection section 220 and hole-punching processing section 240.

When neither punching processing nor folding processing is set, conveyance path switching device G1 closes a conveyance path to hole-punching processing section 240, and opens a conveyance path to the post-processing apparatus ejection section 220.

Sheet S passing through first conveyance path p1 leading to the post-processing apparatus ejection section 220 is pinched by conveyance rollers 221 and 222 to advance straight, and is guided by conveyance path switching device G2 to advance straight, and is ejected from post-processing apparatus ejection section 220 by sheet ejection roller 223 to elevating sheet ejection section 270.

Sheet S that is not to be subjected to the post-processing is guided by conveyance path switching device G2 to be ejected to elevating sheet ejection section 270 as described above. The elevating sheet ejection section 270 has an ejection tray that lowers as the number of sheets S increases, and can store a number of sheets.

Sheet S that is branched away to upper downstream side of conveyance roller 222 in the sheet conveyance direction by conveyance path switching device G2 passes through conveyance roller 225 of sixth conveyance path P6 and is ejected by ejection roller 226 to be fed to sheet storing device 300.

A sheet for a cover or sheet S for insertion stored in sheet feeding tray 231 of sheet adding section 230 is separated and fed by sheet feeding device 232, and is pinched by conveyance rollers 233, 234, 235 and 236 of fifth conveyance path p5, to be conveyed to the conveyance path on the upstream side of a branched portion.

The sheet feeding trays 231 of sheet adding section 230 are arranged on two steps as an upper step and a lower step, and each sheet feeding tray 231 can accept the maximum of 500 sheets as a capacity for covers or sheets S for insertion.

It is also possible to load sheets S on sheet adding section 230, and to conduct hole-punching processing or folding processing on sheets S without conducting image recording.

Sheet S branched by conveyance path switching device G1 of post-processing apparatus carry-in section 210 is pinched by conveyance roller 241 arranged under the conveyance path switching device G1, and is conveyed to hole-punching processing section (first processing section) 240 (second conveyance path p2).

On the conveyance path on the downstream side of the hole-punching processing section 240, there is arranged alignment device 242 which aligns a lateral direction of sheet S before hole-punching processing.

A puncher of the hole-punching processing section 240 is composed of a punch that is driven by an unillustrated driving device and of a die that engages with a blade portion of the punch. The sheet S which has been subjected to hole-punching processing is sent to lower conveyance section 250.

The sheet S sent to the lower conveyance section 250 is pinched by conveyance rollers 251, 252, 253 and 254 to be conveyed to folding processor 260. The conveyance rollers 251, 252, 253 and 254 are composed of driving rollers connected to a driving source and of driven rollers which are in pressure contact with the driving rollers. Each driven roller is connected to solenoid SOL to be capable of being in contact with or separated from the driving roller.

The sheet S which is not to be folded among small-sized sheets S subjected to hole-punching processing passes through third-A conveyance path P3A that is branched from conveyance path switching device G3, and is pinched by conveyance roller 260*a* to be conveyed. Large-sized sheet S which has been subjected to hole-punching processing is conveyed to third-B conveyance path P3B under the branching position of conveyance path switching device G3 independently of necessity of folding processing, then, is conveyed by conveyance rollers 253 and 254 to be introduced to folding processor 260. In this case, the third conveyance path is composed of third-A conveyance path P3A and third-B conveyance path P3B.

When conveyance path switching device 255 is provided on conveyance section 250 and two small-sized sheets S are accumulated to be conveyed, two sheets can be folded simultaneously.

Figure 3:
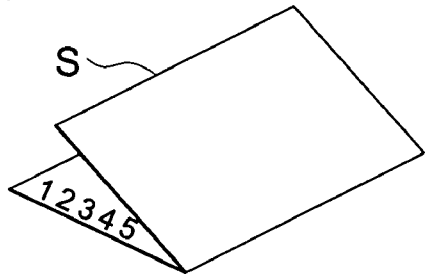
FIGS. 3(*a*), 3(*b*), 3(*c*), 3(*d*) are diagrams showing sheets folded in various forms.
Figure 3:
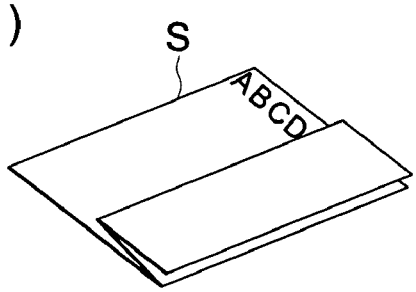
Figure 3:
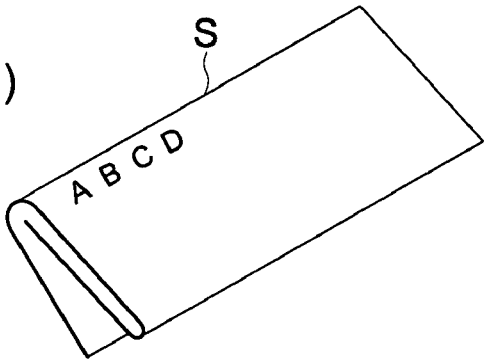
Figure 3:
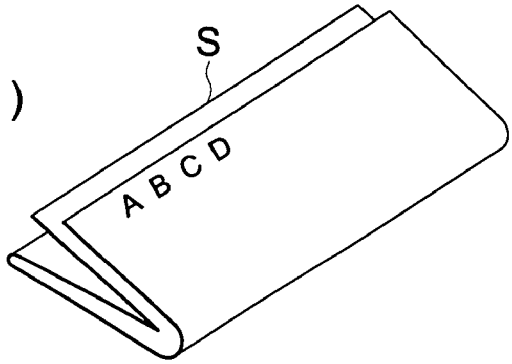

Sheet S conveyed to the folding processor 260 from conveyance section 250 is pinched by registration roller 260*b* to be conveyed and then, is subjected to various types of folding processes such as center-folding (FIG. 3(*a*)), Z-folding (FIG. 3(*b*)), three-folding (FIG. 3(*c*)) and double-parallel folding (FIG. 3(*d*)) in first folding section 261, second folding section 262 and third folding section 263, and returns to the first conveyance path p1 through fourth conveyance path p4.

The sheet S which has been subjected to folding processing by the folding processor 260 is guided upward by conveyance path switching device G2, and is conveyed by conveyance roller 225 and sheet ejection roller 226 to be ejected from post-processing apparatus 200.

<Sheet Storing Device>

Figure 4:
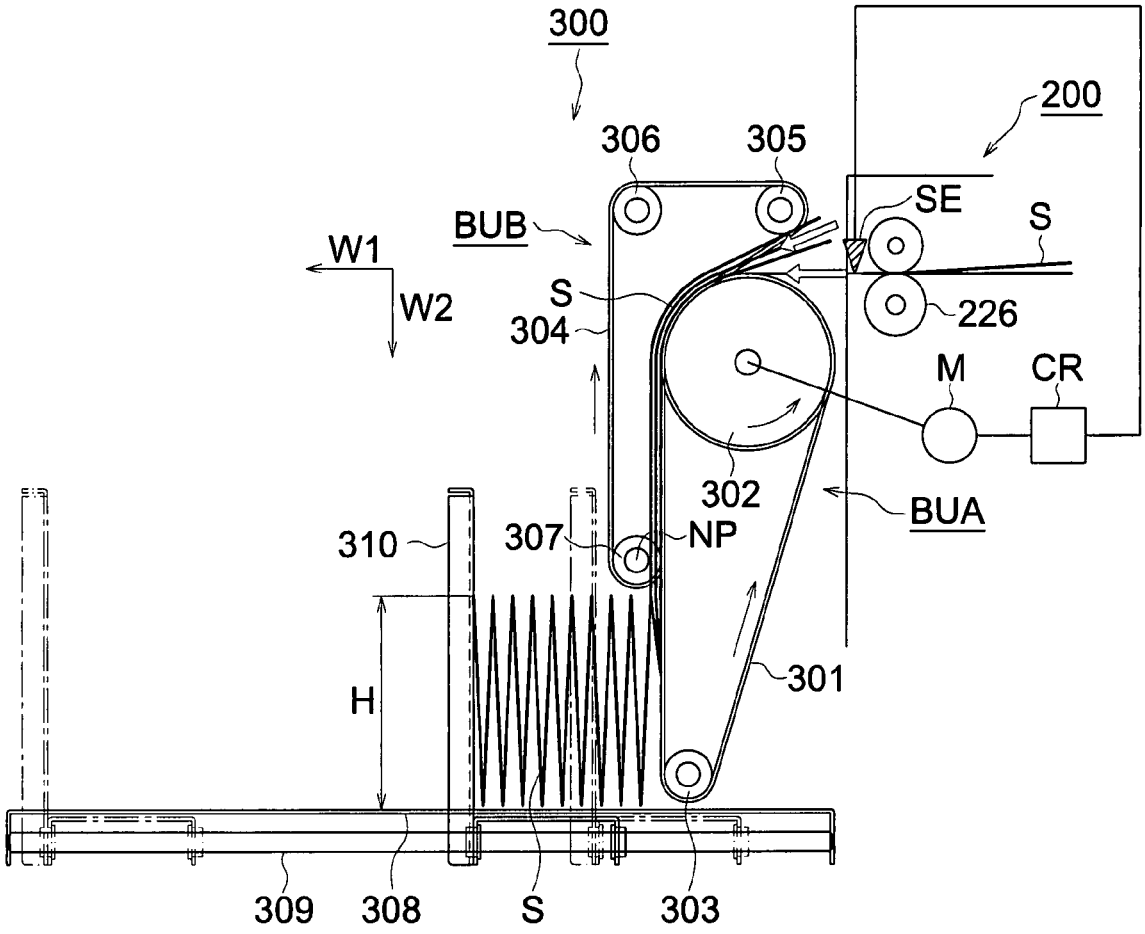
FIG. 4 is a front sectional view of a sheet storing device.
Figure 5:
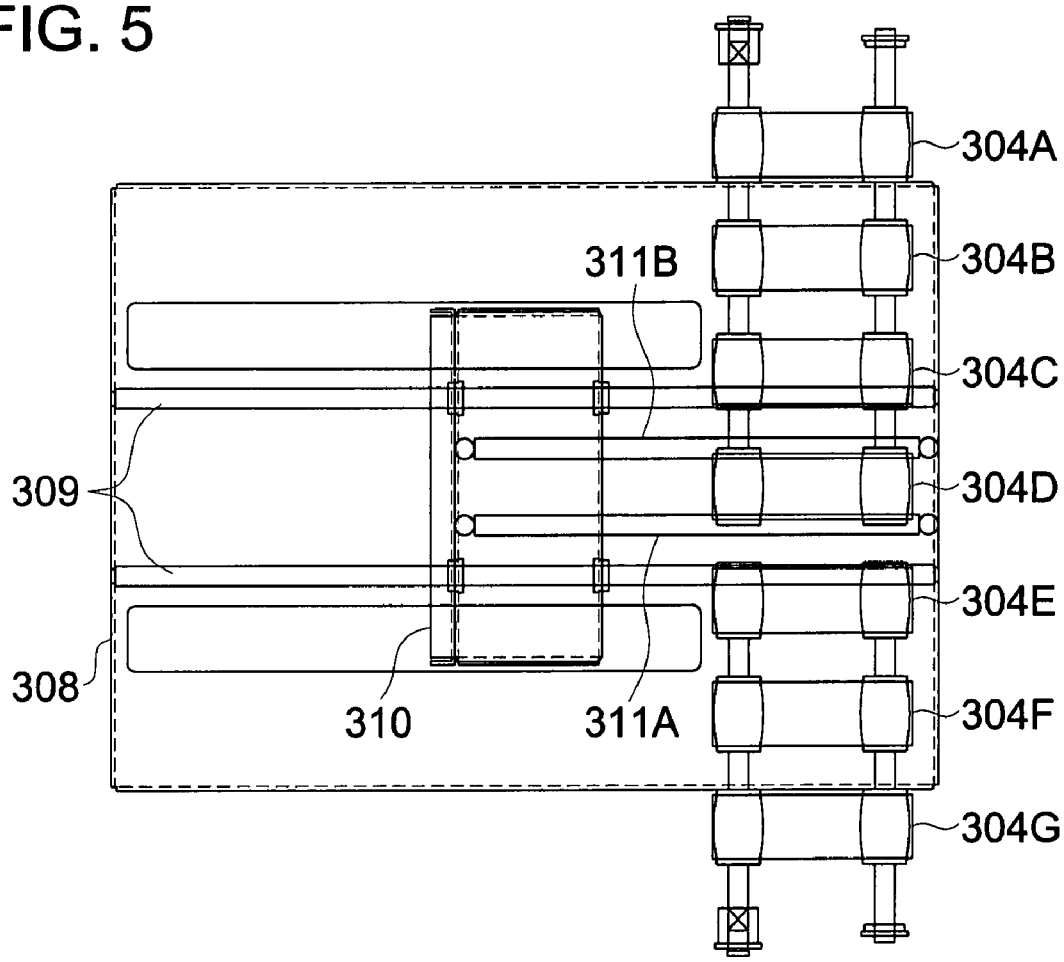
FIG. 5 is a top view of a sheet storing device.

Sheet storing device 300 receives and stores sheet S which has been subjected to folding processing in post-processing apparatus 200. FIG. 4 is a front sectional view of a sheet storing device and FIG. 5 is a top view of a sheet storing device.

The sheet storing device 300 is composed of first belt unit BUA and second belt unit BUB constituting a conveyance device that converts the conveyance direction for sheet S fed into the sheet storing device 300 after folding processing from the horizontal direction to the substantially vertical direction and a storing section having loading table 308 on which sheet S is placed and pressing plate 310 representing a pressing member which are main structural elements.

The first belt unit BUA has therein belt 301 that is composed of a rubber belt, large-diameter roller 302 and small-diameter roller 303. The belt 301 is stretched between the large-diameter roller 302 and the small-diameter roller 303, to revolve (rotate) as shown by an arrow.

The second belt unit BUB has therein belt 304 that is composed of a rubber belt and three small-diameter rollers 305-307. The belt 304 is stretched between the small-diameter rollers 305-307, to rotate as shown by an arrow.

As shown in FIG. 5, the belt 304 is composed of plural belts 304A-304G arranged in parallel in the lateral direction of sheet S. Though FIG. 5 shows only plural belts 304A-304G, belt 301 is also in the same manner, and it is composed of plural belts arranged in parallel in the lateral direction of the sheet.

As illustrated, in the first belt unit BUA, a conveyance surface in the horizontal direction is formed by a portion of belt 301 on a summit portion of large-diameter roller 302, and a conveyance surface in the substantial vertical direction is formed by a left side portion of belt 301 moving downward in the figure.

Belt 304 is in pressure contact with belt 301 along the large-diameter roller 302, and a conveyance direction shown with W1 which is substantially horizontal and a conveyance direction shown with W2 which is substantially vertical are formed, thus, sheet S is held between belt 301 and belt 304 to be conveyed in the direction shown with W1 and then, is conveyed in the direction shown with W2 after a change of direction.

Loading table 308 forms a table surface representing the second supporting surface which is substantially horizontal, and guide bar 309 is provided to be in parallel with the loading table 308, whereby, pressing plate 310 that presses sheet S is guided by the guide bar 309 to move in the horizontal direction, while being urged by springs 311A and 311B and thereby pressing lightly sheet S on the loading table 308. Each of the springs 311A and 311B is a fixed-load spring, and the pressing plate 310 presses sheet S with pressure that is substantially constant, independently of its position accordingly.

When the large-diameter roller 302 is driven by motor M, each of the belts 301 and 304 is rotated as shown with an arrow.

Sheets S are ejected continuously from post-processing apparatus 200 to be detected by sensor SE provided on a sheet ejection section of the post-processing apparatus 200.

Under the situation where sheets S are continuously fed to sheet storing device 300 from post-processing apparatus 200, controller CR starts motor M based on signals of sensor SE that has detected a leading edge of the foremost sheet S among consecutive numerous sheets S, to drive the large-diameter roller 302 for rotation.

The large-diameter roller 302 is accelerated in terms of speed from a resting state, and then, arrives at the conveyance speed that is the same as that of sheet ejection roller 226. After that, it starts to convey sheets at a constant conveyance speed. Then, when the sensor SE detects the trailing edge of the preceding sheet S1, the controller CR stops the drive of motor M temporarily based on the detection signal. Further, based on the detection signal due to detection of the leading edge of the succeeding sheet S2 by the sensor SE, the controller CR restarts the drive of motor M to start the conveyance of the preceding sheet S1 which has been stopped temporarily. The large-diameter roller 302 is accelerated from the temporary stop state and after the conveyance speed of the large-diameter roller 302 reaches that of sheet ejection roller 226, the succeeding sheet S2 arrives at the nip portion of belts 301 and 304 and is conveyed at a constant conveyance speed.

Figure 6:
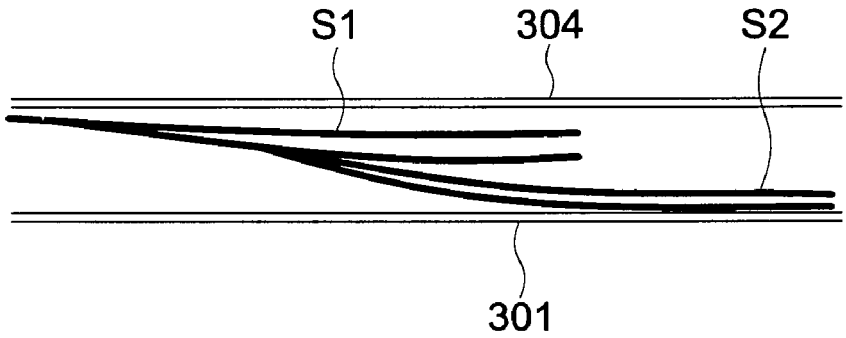
FIG. 6 is a diagram showing how superposed sheets are conveyed.

There is generated a difference between a conveyance distance of sheet ejection roller 226 that conveys at a constant speed and a conveyance distance of the large-diameter roller 302 (belt 301 and belt 304) that is accelerated in terms of a speed from a resting state to the constant speed for conveying. This difference causes preceding sheet S1 and succeeding sheet S2 to be overlapped during continuous conveyance so that plural sheets (preceding sheet S1 and succeeding sheet S2) are held to be overlapped between belt 301 and belt 304, as shown in FIG. 6.

The sheet S thus fed in is held between belt 301 and belt 304 to be changed in terms of a direction from direction W1 to direction W2, and is conveyed downward substantially vertically. After that, the same control is applied to a number of sheets S continuously fed from post-processing apparatus 200 to sheet storing device 300.

Small-diameter roller 307 forms a lower limit of holding the sheet S, namely a lower end position of holding of sheet S to be arranged so that holding lower end position NP may be slightly higher than width H of folded sheet S in the upright position, and there is constructed so that the sheet S released from holding by belt 301 and belt 304 may fall on loading table 308. Incidentally, the holding lower end position NP is at the position that is the same as a rotation center of the small-diameter roller 307 in terms of a height.

As illustrated, plural sheets S are stored on loading table 308 to be substantially perpendicular to the loading table 308. The stacked sheets S are supported by belt 301 representing the first supporting member so that a sheet surface is substantially perpendicular, and a lower end edge of the sheets S is supported by the loading table 308 representing the second supporting member. Since the sheets S are pressed against the belt 301 by pressing plate 310 having a vertical pressing surface, the sheets S are stored in an orderly manner as shown in the figure.

Since plural sheets S are held between belt 301 and belt 304 being overlapped each other to be conveyed and ejected on loading table 308, as described above, a leading edge of succeeding sheet S enters certainly the space between preceding sheet S and belt 301, and sheets S ejected continuously are placed on loading table 308 in parallel. Since a lower edge of the sheets S is supported by the loading table 308, the sheets S are stored on the loading table 308 under the condition that each sheet S is aligned.

The sheet S which has fallen is pressed against belt 301 by pressing plate 310, but the pressing plate 310 presses sheet S with light pressure at a level so that belt 301 can slide on the surface of sheet S without causing any deformation of sheet S, and the pressing plate 310 is urged by constant load springs 311A and 311B to press, thus, the sheet S is pressed by constant pressure that is independent on an amount of sheets S to be stored, and the sheets S are stored under the condition of excellent alignment.

The sheets S conveyed by belt units BUA and BUB and ejected on loading table 308 as stated above are stored to be arranged substantially in the horizontal direction under the condition that their sheet surfaces are perpendicular to the loading table 308.

Based on detection signals from sensor SE that has detected the trailing edge of the rearmost sheet S among sheets S fed to a sheet storing device continuously, controller CR stops motor M at the point in time when a certain period of time has elapsed from the detection of the trailing edge, to terminate sheet storing.

What is claimed is:

1. A sheet storing device comprising:

(i) a conveyance device which conveys a sheet in a conveyance direction and changes the conveyance direction while holding the sheet, the conveyance device comprising:

a first belt unit including a large-diameter roller for changing the conveyance direction, a first small-diameter roller, and a first belt stretched between the large-diameter roller and the first small-diameter roller, and a second belt unit including a plurality of second small-diameter rollers, and a second belt which is stretched between the plurality of second small-diameter rollers and which is in contact with the first belt at least on a portion opposed to the large-diameter roller; and (ii) a storing section for storing the sheet conveyed by the conveyance device, the storing section comprising a first support member for supporting a surface of the sheet, a second support member for supporting an edge of the sheet, and a pressing member for pressing the sheet against the first support member, wherein when conveying and storing sheets, the sheet storing device receives each sheet and overlaps a preceding sheet and a succeeding sheet of the sheets at a point where the first belt on the large-diameter roller and the second belt start to come in contact with each other, and the conveyance device holds and conveys the overlapped sheets, and then releases holding of each of the sheets so that the sheets are stored in the storing section.

2. The sheet storing device of claim 1, wherein the second support member has a substantial horizontal supporting surface and the second support member loads the sheet thereon by gravity force.

3. The sheet storing device of claim 1, wherein the first support member has a supporting surface substantially perpendicular to the second support member and the pressing member has a pressing surface substantially perpendicular to the second support member.

4. The sheet storing device of claim 1, wherein the conveyance device constitutes the first support member.

5. The sheet storing device of claim 1, further comprising, an urging device for urging the pressing member with a constant load, wherein the pressing member is movable along a supporting surface of the second support member.

6. The sheet storing device of claim 1, wherein the conveyance device continuously conveys the sheets with a trailing edge of the preceding sheet and a leading edge of the succeeding sheet next to the preceding sheet overlapping each other.

7. The sheet storing device of claim 1, further comprising:

a sensor for detecting the sheet; and a controller for starting the conveyance device based on a sheet leading edge detection signal of the sensor.

8. The sheet storing device of claim 7, wherein the controller stops the conveyance device based on a sheet trailing edge detection signal of the sensor.

9. The sheet storing device of claim 1, wherein the first and second belt units convert the conveyance direction of the sheet conveyed and introduced substantially horizontally to the first and second belt units so that the sheet is conveyed downward substantially vertically.

10. The sheet storing device of claim 9, wherein the conversion of the conveyance direction of the sheet is conducted by a conveyance along a part of a circumferential surface of the large-diameter roller of the first belt unit.

11. The sheet storing device of claim 1, wherein the conveyance device releases holding of the sheet at a point which is higher than a height of the sheet in an upright position on the second support member.

12. A post-processing unit comprising:

a post-processing apparatus for folding a sheet; and the sheet storing device of claim 1 for conveying and storing the sheet folded by the post-processing apparatus.

13. An image forming system, comprising:

an image forming apparatus for forming an image on a sheet;

a post-processing apparatus for folding the sheet ejected from the image forming apparatus; and the sheet storing device of claim 1 for storing the sheet folded by the post-processing apparatus.

* * * * *